United States Patent [19]

Sonobe et al.

[11] 4,106,557

[45] Aug. 15, 1978

[54] OPEN-TYPE BOILING COOLING APPARATUS

[75] Inventors: Hisao Sonobe, Ibaraki; Sadayuki Okada, Katsuta; Etsuo Oe, Hitachi; Hideo Tsukioka, Mito; Moriichi Sato, Hitachi, all of Japan

[73] Assignee: Hitachi, Ltd., Japan

[21] Appl. No.: 721,409

[22] Filed: Sep. 8, 1976

[30] Foreign Application Priority Data

Sep. 20, 1975 [JP] Japan ..... 50-114002

[51] Int. Cl.[2] ..... F28D 15/00

[52] U.S. Cl. ..... 165/105; 165/DIG. 22; 357/82; 361/385; 174/15 R

[58] Field of Search ..... 165/105, DIG. 22; 336/58; 174/15 R, 15 HP; 357/82; 361/385

[56] References Cited

U.S. PATENT DOCUMENTS

| | | | |
|---|---|---|---|
| 1,533,463 | 4/1925 | Postel | 165/105 X |
| 1,883,830 | 10/1932 | Palley | 165/106 X |
| 2,214,865 | 9/1940 | Troy | 165/105 X |
| 2,849,523 | 8/1958 | Narbut | 165/105 X |
| 2,858,355 | 10/1958 | Narbut | 165/105 X |
| 3,682,237 | 8/1972 | Islo | 165/105 X |

*Primary Examiner*—Albert W. Davis, Jr.
*Attorney, Agent, or Firm*—Craig & Antonelli

[57] ABSTRACT

An apparatus for cooling a heat generating member by utilizing the latent heat of vaporization of a boiling refrigerant, having a cooling vessel including an evaporator section containing the boiling refrigerant and adapted to transmit the heat generated by the heat generating member to the refrigerant, and a condenser section for liquefying the gasified refrigerant; a liquid refrigerant reservoir open at its upper end and adapted to store a body of the refrigerant which does not directly take part in a cooling operation while the cooling operation is being performed; and a communication means for communicating the cooling vessel with the liquid refrigerant reservoir, the cooling vessel and the communication means being filled with the boiling refrigerant.

32 Claims, 10 Drawing Figures

OPEN-TYPE BOILING COOLING APPARATUS

BACKGROUND OF THE INVENTION

This invention relates to boiling cooling apparatus for cooling a heat generating member by utilizing the latent heat of vaporization of a boiling refrigerant, and more particularly to an open-type boiling cooling apparatus in which a cooling operation is performed at the atmospheric pressure.

A boiling cooling apparatus of the prior art essentially comprises an evaporator and a condenser which are enclosed in a sealed cooling vessel. The internal pressure of the cooling vessel may vary depending on the temperature of the refrigerant, and the temperature of the refrigerant varies greatly if there is a change in the ambient temperature or the amount of heat generated by the heat generating member. When, for example, $C_2Cl_3F_3$ (Freon R-113) which is one of halogenated hydrocarbons is used as a refrigerant, the internal pressure of the cooling vessel varies from 0.15 kg/cm$^2$ to 4.5 kg/cm$^2$ (absolute pressure) when the temperature of the refrigerant changes from 0° to 100° C. Under such conditions, if the cooling vessel is not sealed airtight, a non-condensable gas, such as air, will invade the cooling vessel and greatly lower the performance of the condenser, in the event that the internal pressure is lower than the atmospheric pressure (1.033 kg/cm$^2$ in absolute pressure). This will make it impossible for the cooling vessel to achieve the desired cooling effect, thereby causing inordinate overheating of or damage to the heat generating member. In case the internal pressure of the cooling vessel is higher than the atmospheric pressure, the refrigerant will be wasted by escaping from the cooling vessel to outside. This will also make it impossible for the cooling vessel to effect cooling satisfactorily. Thus the same result will be achieved when the internal pressure is higher than the atmospheric pressure as when the internal pressure is lower than the atmospheric pressure.

An important problem encountered when prior art apparatus are used is how to keep the cooling vessel airtight. Although the cooling vessel is constructed by welding together its parts, it is no easy matter to provide a completely airtight seal to the cooling vessel even if up-to-date techniques are utilized. Particularly, it is almost impossible to provide an airtight seal to a cooling vessel of a large size. When a refrigerant is charged into a cooling vessel, it is necessary to discharge all the non-condensable gas from the cooling vessel and the refrigerant. If this is not done satisfactorily, it will be impossible to obtain predetermined performance of the condenser, as it happens when no completely airtight seal is provided. To open the cooling vessel, it has hitherto been necessary to break open the welded joints. Thus difficulty has been experienced in effecting maintenance of the heat generating member.

The problem of how to provide an airtight seal to a cooling vessel could be solved if the apparatus were kept at the atmospheric pressure at all times. Stated differently, if the interior of the apparatus is kept at the atmospheric pressure, there will be no difference in pressure between the inside and the outside of the apparatus, thereby putting an end to mutual interference.

One problem encountered in keeping the interior of the apparatus at the atmospheric pressure is that the apparatus itself may become complex in construction and large in size. There is a dilemma as to whether an apparatus can be maintained at the atmospheric pressure without having air in the interior thereof.

For reasons stated above, it has hitherto been impossible to provide boiling cooling apparatus in which the problem of airtightness is solved and which has satisfactory cooling capabilities.

SUMMARY OF THE INVENTION

Keeping in mind the aforementioned problems of the prior art, this invention has as its object the provision of an open-type boiling cooling apparatus which enables the interior of the apparatus to be maintained at the atmospheric pressure without making the apparatus complex in construction and large in size, and which can achieve satisfactory cooling effect.

In general, an open-type boiling cooling apparatus comprising a cooling vessel including an evaporator section containing a boiling refrigerant and adapted to transmit the heat of a heat generating member to the refrigerant and a condenser section for liquefying the gasified refrigerant and a liquid refrigerant reservoir means communicating with the cooling vessel and open at its end, when made in accordance with this invention, permits a body of the refrigerant which does not directly take part in a cooling operation when such cooling operation is performed to be transferred to the liquid refrigerant reservoir means, so that a space can be provided for liquefying the refrigerant gasified in the condenser section.

DESCRIPTION OF THE PREFERRED EMBODIMENTS

Figure 1:
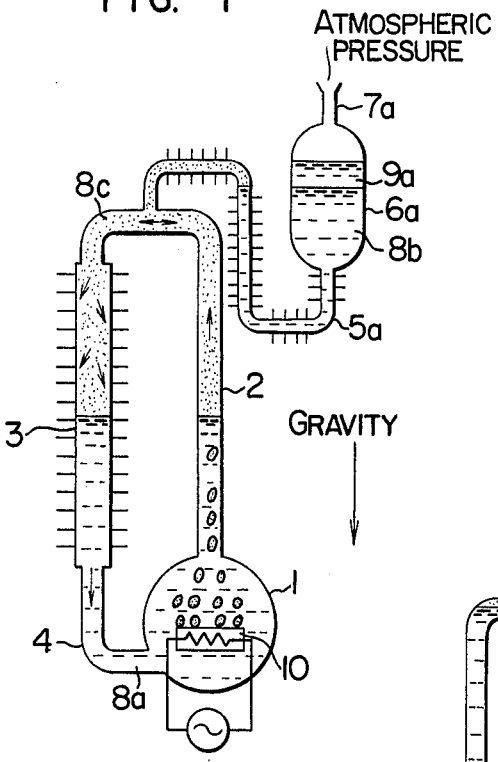
FIG. 1 is a schematic view of the open-type boiling cooling apparatus comprising one embodiment of the invention.

FIG. 1 shows one embodiment of this invention wherein the open-type boiling cooling apparatus comprises an evaporator 1, a gas pipe 2, a condenser 3, a return pipe 4, a condensing pipe 5*a*, a liquid refrigerant reservoir 6*a* and an inlet and outlet pipe 7*a*. 8*a* and 8*b* designate a refrigerant in a liquid state which is a halogenated hydrocarbon. In this specification, some of the reference numerals designating different parts each have a letter of an alphabet attached as a suffix, in order that the operation of the apparatus may be better understood. Each reference numeral having no suffix attached thereto generally designates a part of the apparatus.

The halogenated hydrocarbon 8*a*, 8*b* may be selected from the group of halogenated hydrocarbons comprising carbon tetrachloride ($CCl_4$, Freon R-10), 1, 2-difluorotetrachloroethane ($CCl_2F.CCl_2F$, Freon R-112), 1,1,2-trichlorotrifluoroethane ($CCl_2FCClF_2$, Freon R-113), 1-chloro-1,2-dibromo-1,2,2-trifluoroethane ($CBrClF.CBrF_2$, Freon R-113B2), 1,2-dibromotetrafluoroethane ($CBrF_2CBrF_2$, Freon R-114B2), 1,1,1-trichloroethane ($CCl_3CH_3$, Freon R140), 1,2-dichlorofluoroethane ($CH_2ClCHClF$, Freon R-141), 1,1,1-trichloropentafluoropropane ($CCl_3CF_2CF_3$, Fron R-215), 1,2-dichlorohexafluorocyclobutane $$\left(\begin{array}{l} CF_2-CClF, \\ | \\ CF_2-CClF \end{array}\right.$$

Freon R-C316), 2,3-dichloro-octafluorobutane ($CF_3CFClCFClCF_3$, Freon R-318), cyclic-$C_6F_{12}O$ (FLUORINERT FC-78 made by Minnesota Mining and Manufacturing Company of the U.S.A.), $C_4HF_{11}O$ (Freon El made by E.I. du Pont de Nemours and Company of the U.S.A.), perfluoro-n-hexane ($C_6F_{14}$, FLUTEC PPl made by Imperial Smelting Company of Great Britain). At least one of the above-mentioned hydrocarbons is used in the present invention.

8*c* designates refrigerant in a gaseous state, 9*a* a liquid for sealing the refrigerant in the liquid refrigerant reservoir 6*a*, and 10 a heat generating member. The arrows indicate the directions in which the refrigerant flows. Various parts of the apparatus will be described more in detail. In the evaporator 1, the liquid refrigerant 8*a* therein boils and is changed into the gaseous refrigerant 8*c*, and the heat generating member 10 is cooled by the latent heat of vaporization of the liquid refrigerant 8*a*. The gaseous refrigerant 8*c* is led through the gase pipe 2 to the condenser 3 where the gaseous refrigerant 8*c* is condensed and liquefied. When the gaseous refrigerant 8*c* is condensed and changed back to a liquid state, the latent heat of the gaseous refrigerant 8*c* is transmitted to an external coolant or to the air outside the apparatus, for example. The liquid refrigerant 8*a* which has been changed back to a liquid state at the condenser 3 is returned, through the return pipe 4, to the evaporator 1. The condensing pipe 5*a* performs the function of preventing the gaseous refrigerant 8*c* from directly entering the liquid refrigerant reservoir 6*a* by virtue of the phenomenon that the gaseous refrigerant which is lighter than the liquid refrigerant is unable to readily flow downwardly through the liquid refrigerant and by the condensing action of the pipe 5*a*. The liquid refrigerant reservoir 6*a* performs the function of storing the liquid refrigerant 8*b* which does not directly take part in the cooling operation. The inlet and outlet pipe 7*a* is designed to communicate the reservoir 6*a* with the atmosphere as well as to prevent the effusion of the refrigerant sealing liquid 9*a*. The refrigerant liquid 8*a* has a boiling point which is equal to the temperature to which the heat generating member 10 is intended to be cooled, while the refrigerant liquid 8*b* which is of the same composition as the liquid refrigerant 8*a* is the liquid refrigerant discharged from a cooling vessel subsequently to be described. The gaseous refrigerant 8*c* is the liquid refrigerant 8*a* in a gaseous state.

The refrigerant sealing liquid 9*a* is required to have the properties of being immiscible with the liquid refrigerant 8*a*, having a specific gravity which is lower than that of the liquid refrigerant 8*a*, of not readily evaporating, and having a viscosity which is not so high. The liquid 9*a* is intended to prevent spontaneous evaporation of the liquid refrigerant 8*b* and its escape into the atmosphere through the inlet and outlet pipe 7*a*. The liquid refrigerant sealing liquid 9*a* may be an aqueous solution of at least one material selected from the group consisting of polyhydric alcohols including ethylene glycol ($CH_2OHCH_2OH$), diethylene glycol ($HOCH_2CH_2OCH_2CH_2OH$), triethylene glycol ($HOCH_2CH_2OCH_2CH_2OCH_2CH_2OH$), 1,4-butanediol [$HO(CH_2)_4OH$], and glycerin ($HOCH_2CHOHCH_2OH$); polysaccharides including D-glucose, D-xylose and D-galactose polyvinyl alcohols; and glucose including starch, glycogen and cellulose.

The heat generating member 10 is an element to be cooled and may be, for example, a semiconductor element or a transformer or other electrical equipment. The term "cooling vessel" is defined as a vessel in which the evaporator 1, gas pipe 2, condenser 3 and return pipe 4 are connected together. The term cooling vessel is used herein as indicating the basic structure of apparatus of the prior art. In the present invention, the liquid refrigerant reservoir 6*a* has a volume which is greater than the volume of the liquid refrigerant 8*b*, which should be discharged from the cooling vessel when the condenser functions at 100% efficiency, plus the volume of the sealing liquid 9*a*. The essential minimum quantity of the liquid refrigerant charged into the cooling vessel should be sufficiently large to fill the cooling vessel and the condensing pipe 5. The larger the quantity of the sealing liquid 9*a*, the better. At a minimum, however, the quantity of the sealing liquid 9*a* may be such that a liquid layer is formed on the liquid refrigerant 8*b* in the reservoir 6*a*.

In operation, when the amount of heat generated by the heat generating member 10 is zero, the liquid refrigerant 8*a* does not boil and no gaseous refrigerant 8*c* is produced. Thus the liquid refrigerant 8*b* passes into a space in the gas line 2 and the condenser 3 which is indicated by dots and which is adapted to be filled with the gaseous refrigerant 8*c* when a cooling operation is performed. This causes lowering of the liquid level of the liquid refrigerant 8*b* in the reservoir 9*a*, resulting in the lowering of the liquid level of the sealing liquid 9*a*. As a result, the cooling vessel, the condensing pipe 5 and the lower portion of the liquid refrigerant reservoir 6*a* are filled with the liquid refrigerant 8. When the apparatus is in this condition the internal pressure of the cooling vessel has a highest value in the lower portion of the vessel, such value being equal to the value of the atmospheric pressure plus the value of the pressure of the liquid column. However, in the case of a cooling vessel of a large size, the pressure of the liquid column is neglible, so that the internal pressure can be regarded as being equal to the atmospheric pressure.

The process during which the apparatus changes from the abovementioned condition to the condition shown in FIG. 1 will not be described. In the initial stages of heat generation by the heat generating member 10, the liquid refrigerant 8*a*, does not immediately boil and flows in the directions indicated by the arrows, so that natural convection occurs. Cooling is not effected satisfactorily by this phenomenon alone and the temperature of the liquid refrigerant 8*a* rises. Upon the temperature of the liquid refrigerant 8*a* approaching the saturation temperature at the atmospheric pressure or the boiling point, vigorous boiling of the liquid refrigerant occurs on the surface of the heat generating member 10 and the liquid refrigerant is changed to the gaseous refrigerant 8*c*. This results in a rise in the internal pressure of the cooling vessel, so that the liquid refrigerant 8*a* and the gaseous refrigerant 8*c* pass through the condensing pipe 5*a* toward a lower pressure part or the liquid refrigerant reservoir 6*a*. At this time, the gaseous refrigerant 8*c* is cooled and liquefied before reaching the reservoir 6*a*. The body of the liquid refrigerant 8*a* that has passed to the reservoir 6*a* in this way is the liquid refrigerant 8*b*. The quantity of the liquid refrigerant 8*b* may vary depending on the amount of heat generated by the heat generating member 10, the boiling point of the refrigerant and the temperature of the external coolant of the condenser 3. If the boiling point and the temperature of the external coolant of the condenser 3 are constant, the quantity of the liquid refrigerant 8*b* will depend on the amount of generated heat alone. If this is the case, equilibrium will be established in the apparatus when a sufficiently large space is secured for the gasified refrigerant 8*c* or a sufficiently large area is secured for the condensing action of the condenser 3 in the cooling vessel to enable the cycle of boiling and condensation to be intiated and repeated as indicated by the arrows without a further rise in the temperature of the liquid refrigerant 8*a*. At this time, the temperature of the liquid refrigerant 8*a* is substantially the same as its boiling point, and the internal pressure of the cooling vessel is substantially equal to the atmospheric pressure.

In FIG. 1, only one-half portion of the condenser 3 is shown as functioning effectively. At this time, the amount of heat generated by the heat generating member 10 is half the maximum amount of heat to be generated. If the amount of the heat generated by the heat generating member 10 is further increased without exceeding its maximum value, the temperature of the liquid refrigerant 8*a* will slightly increase. However, a rise in the temperature of the liquid refrigerant 8*a* will result in an increase in the internal pressure of the cooling vessel, and the gasified refrigerant 8*c* begins to pass toward the liquid refrigerant reservoir 6*a*. Thus the gasified refrigerant 8*c* will be liquefied at the condensing pipe 5*a* and the liquefied refrigerant will be added to the liquid refrigerant 8*b* in the reservoir 6*a*. If the liquid refrigerant 8*a* is changed to a gaseous state and released from the cooling vessel, the quantity of the liquid refrigerant 8*a* in the cooling vessel will decrease. This causes an increase in the condensing area of the condenser 3, so that the cycle of boiling and condensation will be repeated with increased intensity and the temperature of the liquid refrigerant 8*a* will stop rising. As a result, the temperature of the liquid refrigerant 8*a* will be maintained at a level which is slightly higher than the boiling point of the refrigerant and the internal pressure of the cooling vessel will reach a level which is slightly higher than the atmospheric pressure.

The aforementioned description refers to an operation in which the amount of heat generated by the heat generating member 10 increases from zero to the maximum value. Conversely, if the amount of heat generated by the heat generating member 10 is reduced from its maximum value to zero, the temperature of the liquid refrigerant 8*a* will show a decrease which is consistent with a reduction in the amount of generated heat. This will cause a reduction in the internal pressure of the cooling vessel, with the result that the liquid refrigerant 8*b* will pass from the reservoir 6*a* to the cooling vessel and the condensing or effective area of the condenser 3 will be reduced. This will automatically maintain the temperature of the liquid refrigerant 8*a* at a level near its boiling point and will maintain the internal pressure of the cooling vessel at a level near the atmospheric pressure.

When the apparatus is assembled, non-condensable gas present in the interior of the cooling vessel and the liquid refrigerant 8*a* may remain therein without being discharged completely therefrom. However, this causes no trouble at all, because the non-condensable gas will pass to the liquid refrigerant reservoir 6*a* when the liquid refrigerant 8*a* in the cooling vessel passes to the reservoir 6*a* and will be vented to the atmosphere through the inlet and outlet pipe 7*a*. Thus, there is no trouble of non-condensable gas being entrapped in the interior of the cooling vessel.

In accordance with the present invention described with reference to the embodiment thereof shown in FIG. 1, it is possible to maintain the internal pressure of the boiling cooling apparatus at the same level as the atmospheric pressure without rendering the construction of the apparatus complex and without increasing the size thereof. Since the internal pressure is maintained at the same level as the atmospheric pressure at all times, the invention offers the following advantages. There is no trouble of lowering of the performance of the condenser 3 which might be caused by the invasion of the cooling vessel by non-condensable gas. The liquid refrigerant 8*a* is prevented from being released to the outside from the cooling vessel. The strength requirement of the cooling vessel is low, so that the cooling vessel of a considerably low strength can perform its function without any trouble. Since the temperature of the liquid refrigerant 8*a* is maintained at its boiling point at all times, the surface temperature of the heat generating member 10, which is the member to be cooled, can be kept substantially constant.

Figure 2:
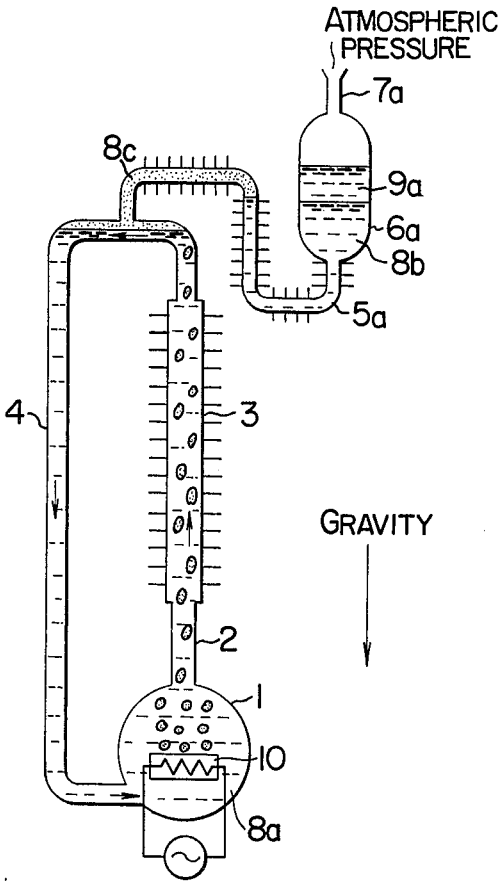
FIG. 2 to FIG. 10 are schematic views of other embodiments of the invention.
Figure 3:
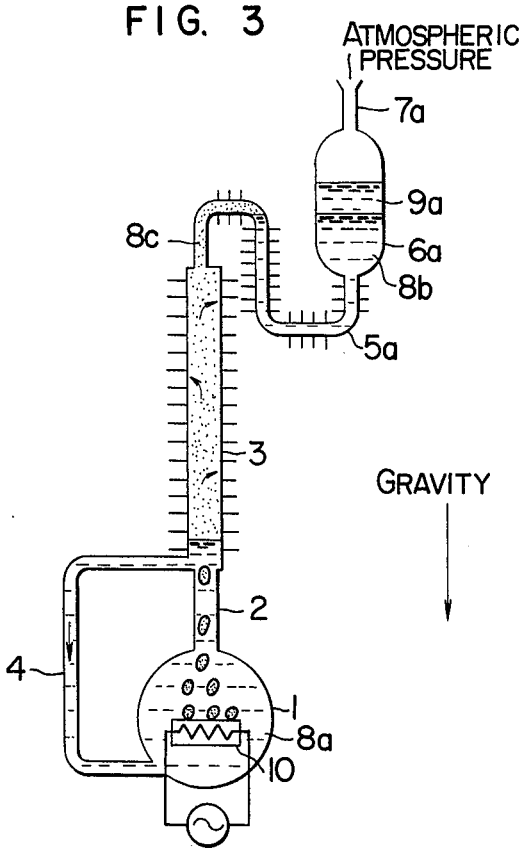
Figure 4:
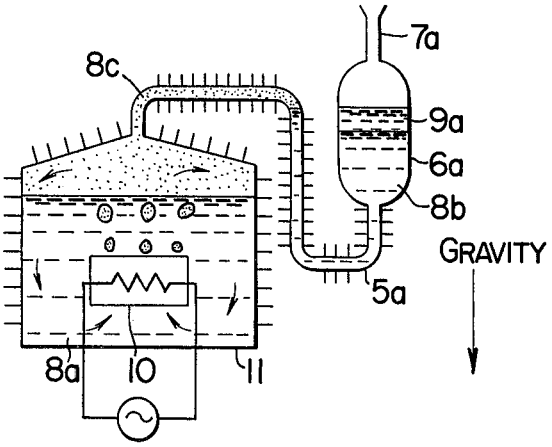

FIG. 2, FIG. 3 and FIG. 4 show other embodiments of the invention in operation. These embodiments differ from the embodiment shown in FIG. 1 in the circulating system of the gasified refrigerant 8*c*. Particularly, in the embodiment shown in FIG. 4, the evaporator 1, gas pipe 2, condenser 3 and return pipe 4 are combined into a single cooling vessel 11. However, in all these embodiments, the liquid refrigerant 8*a* passes to and from the liquid refrigerant reservoir 6*a* through the condensing pipe 5*a* to thereby automatically effect adjustments of the condensing area and to maintain the temperature of the liquid refrigerant 8*a* at its boiling point, as is the case with the embodiment shown in FIG. 1. The embodiments shown in FIG. 2, FIG. 3 and FIG. 4 perform the same cooling function and achieve the same results as the embodiment shown in FIG. 1. Description will be given hereinafter on the specific operation and effects of these embodiments. It is to be understood that in FIG. 1 to FIG. 10, like reference characters designate similar parts in all the drawings.

In the embodiment shown in FIG. 2, the gaseous refrigerant 8*c* and the liquid refrigerant 8*a* pass together from the lower portion to the upper portion of the condenser 3 at a relatively high speed. Any non-condensable gas which might be present in the refrigerant can be pushed upwardly and no non-condensable gas is present in the condenser 3, so that condensation of the gaseous refrigerant can be performed with a high degree of efficiency. When the liquid refrigerant 8*a* and the gaseous refrigerant 8*c* pass to the liquid refrigerant reservoir 6*a*, they never fail to pass through the condenser 3, so that almost all the gaseous refrigerant 8*c* is liquefied and this enables the use of the condensing pipe 5 of a low condensing capability. Moreover, the gas pipe 2 is short in length and the gaseous refrigerant 8*c* is liquefied in the condenser 3 as soon as it is released from the evaporator 1. This is conducive to reduced space to be occupied by the gaseous refrigerant 8*c* in the cooling vessel. This in turn minimizes the quantity of the liquid refrigerant 8*a* which should be discharged from the cooling vessel to the outside. As a result, it is possible to reduce the volume of the liquid refrigerant reservoir 6*a*.

The embodiment shown in FIG. 3 makes it possible to achieve substantially the same effects as those achieved by the embodiment shown in FIG. 2.

In the embodiment shown in FIG. 4, the cooling vessel 11 performs the function of a condenser in all the parts thereof (to be exact, a portion which is filled with the liquid refrigerant 8*a* cannot be referred to as a condenser because the transference of heat taking place therein is mainly by convection). Thus the apparatus is structurally faultless and has particular utility when the heat generating member 10 is large in size.

Other embodiments of the invention are shown in FIG. 5, FIG. 6, FIG. 7 and FIG. 8. These embodiments differ from the embodiments shown in FIG. 1, FIG. 2, FIG. 3 and FIG. 4 in the shape and number of the condensing pipe 5 and the number and arrangement of the liquid refrigerant reservoir 6*a*. These embodiments do not differ in the structure of the cooling vessel from the embodiments shown in FIG. 1, FIG. 2, FIG. 3 and FIG. 4. Any of the cooling vessels shown in the latter figures may be used or a cooling vessel of any other form may be used. For purposes of illustration, the embodiments shown in FIG. 5, FIG. 6, FIG. 7 and FIG. 8 will be described as using the cooling vessel shown in FIG. 1. These embodiments do not differ from the embodiments shown in FIG. 1, FIG. 2, FIG. 3 and FIG. 4 in the basic functions of maintaining the temperature of the liquid refrigerant 8 at its boiling point and maintaining the internal pressure of the cooling vessel at the level of the atmospheric pressure at all times by causing a change to occur in the condensing area of the condenser 3 as the liquid refrigerant 8 passes to the reservoir 6*a*, so that the condensing capability will change in accordance with a variation in the amount of heat generated.

Specific features incorporated in various embodiments will now be described.

Figure 5:
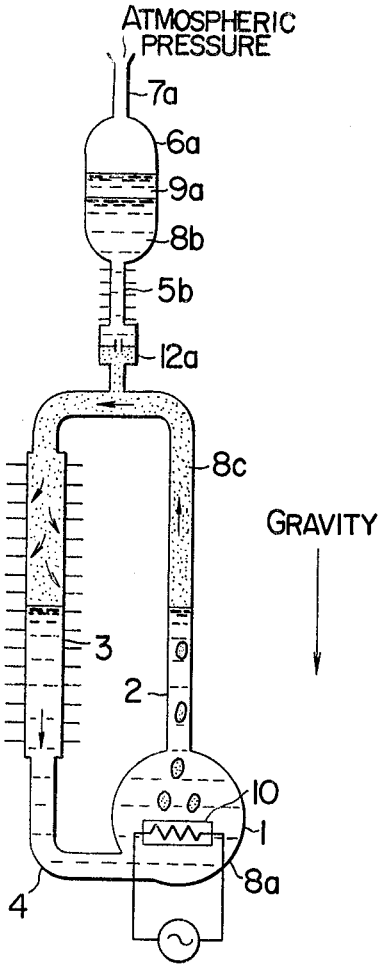

In the embodiment shown in FIG. 5, the condensing pipe 5*b* has no downward flow portion, and this type of condensing pipe facilitates the venting of non-condensible gas from the cooling vessel. A throttle pipe 12*a* is intended to restrict the quantity of the gaseous refrigerant 8*c* in accordance with the condensing capability of the condensing pipe 5*b* to thereby prevent the gaseous refrigerant 8*c* from directly entering the liquid refrigerant reservoir 6*a*. The throttle pipe 12 may be eliminated if the condensing pipe 5*b* is sufficiently thin to offer great resistance to the flow of the gaseous refrigerant 8*c* through the bore thereof. This embodiment permits venting of non-condensable gas to be effected readily. Thus no special steps need be taken for freeing the cooling vessel or the liquid refrigerant 8*a* of non-condensible gas when a charge of the liquid refrigerant 8 is introduced into the cooling vessel. The liquid refrigerant can be readily charged into the cooling vessel.

Figure 6:
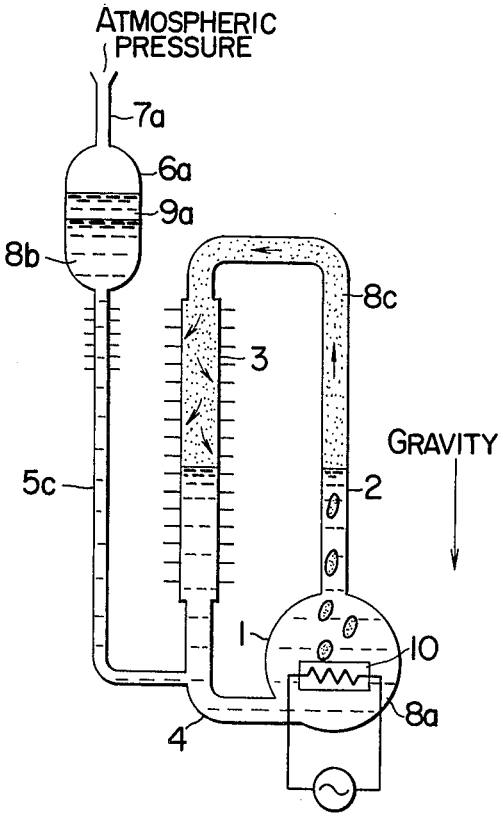

The specific structural distinction of the embodiment shown in FIG. 6 from other embodiments is that the liquid refrigerant reservoir 6*a* communicates at its lower portion with the lower portion of the cooling vessel. Since there is no gaseous refrigerant 8*c* in the lower portion of the cooling vessel the gaseous refrigerant 8*c* is prevented from directly entering the condensing pipe 5*c*. Thus, in this embodiment, the condensing pipe 5*c* may be in the form of an ordinary pipe which does not perform the condensing function. Thus, the apparatus is most simple from the structural point of view and yet is capable of operating in a stable manner.

In this embodiment, the non-condensible gas entrapped in the cooling vessel is released to the outside with less ease than other embodiments. This makes it imperative to take steps to vent the non-condensable gas from the cooling vessel and the liquid refrigerant 8*a* when the liquid refrigerant 8*a* is charged into the cooling vessel.

Figure 7:
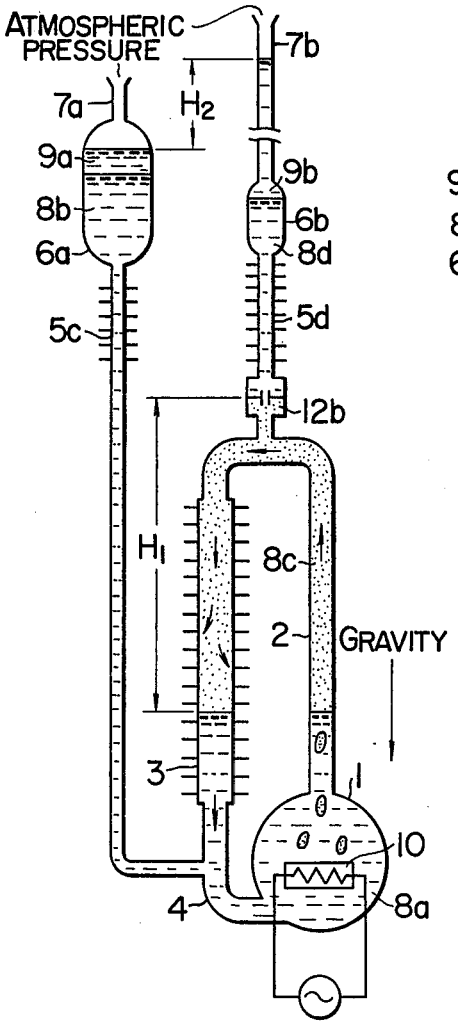

The embodiment shown in FIG. 7 represents a combination of the embodiments shown in FIG. 5 and FIG. 6. As shown, structural components similar to those of the embodiment shown in FIG. 5 and comprising a throttle pipe 12*b*, a condensing pipe 5*d*, a liquid refrigerant reservoir 6*b* and an inlet and outlet pipe 7*b* perform the function of venting non-condensable gas remaining in the cooling apparatus. The throttle pipe 12*b* has a higher degree of throttling than the throttle pipe 12*a* of FIG. 5; the condensing pipe 5*d* has a lower condensing capability than the condensing pipe 5*b* of FIG. 5; the reservoir 6*b* has a smaller volume than the reservoir 6*a* of FIG. 5; and the inlet and outlet pipe 7*b* is longer than the inlet and outlet pipe 7*a* of FIG. 5. These structural components of FIG. 7 have a greater length and a smaller thickness than the corresponding structural components shown in FIG. 5. A liquid refrigerant 8*d* is a portion of the liquid refrigerant 8*a* which has passed to the reservoir 6*b*. A liquid 9*b* is similar to the liquid 9*a*. Other structural components are similar to the corresponding parts shown in FIG. 6. The throttle valve 12*b* performs the same function as the throttle valve 12*a* shown in FIG. 5.

In the aforementioned structure, excess refrigerant 8*a* passes to the liquid refrigerant reservoir 6*a* through the condensing pipe 5*c* and to the liquid refrigerant reservoir 6*b* through the condensing pipe 5*d* in order to provide a desired condensing area in the cooling vessel which is commensurate to the amount of heat generated by the heat generating member 10. As a result, the liquid level of the sealing liquid 9*b* becomes higher than the liquid level of the sealing liquid 9*a* by a value $H_2$ which is equal to the height $H_1$ of the space occupied by the gaseous refrigerant 8*c* in the cooling vessel. Thus equilibrium is established in the cooling vessel and a cooling operation is performed. When this is the case, it is possible to use the condensing pipe 5*d* of a lower condensing capability if the quantity of the liquid refrigerant 8*d* passing to the liquid refrigerant reservior 6*b* is small thereby enabling a compact size to be obtained in a condensing pipe. The most simple procedure to reduce the quantity of the liquid refrigerant 8*d* is to reduce the volume of the liquid refrigerant reservior 6*b* and the adjacent parts by decreasing the thickness of these parts. The condensing pipe 5*d*, liquid refrigerant reservior 6*b* and inlet and outlet pipe 7*b* may be combined into a single pipe form.

As aforementioned, the embodiment shown in FIG. 7 performs the function of automatically venting non-condensable gas entrapped in the cooling vessel in addition to the functions performed by the embodiment shown in FIG. 6. Thus, the apparatus can exhibit a better performance.

Figure 8:
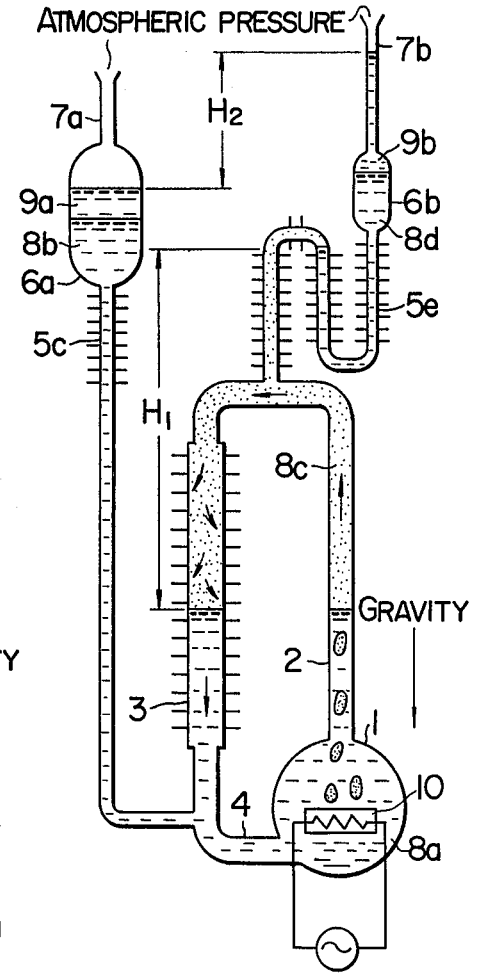

In the embodiment shown in FIG. 8, the throttle pipe 12*b* and condensing pipe 5*d* of the embodiment shown in FIG. 7 are replaced by a condensing pipe 5*e* which is similar to the condensing pipe 5*a* of the embodiment shown in FIG. 1 and which has a lower condensing capability than the condensing pipe 5*a*. The embodiment of FIG. 8 is more or less similar to the embodiment of FIG. 7 in operation and the effects achieved.

In each embodiment of the invention, there are no limits to the size or length of the inlet and oulet pipe 7.

By increasing the length of the pipe 7 as much as possible and letting it stick upwardly out of the cooling vessel, it is possible to maximize the cooling capabilities of the apparatus. The reason for this is as follows. In the event that the temperature of the liquid refrigerant 8 rises above its boiling point even if the condenser 3 operates at 100% efficiency when the amount of heat generated by the heat generating member 10 is excessively great, the internal pressure of the cooling vessel will become higher than the atmospheric pressure. The result of this is that the sealing liquid 9 will first gush out, followed by the liquid refrigerant 8. When this phenomenon occurs, if the inlet and outlet pipe 7 has a great length, the sealing liquid 9 will not gush out because the pressure of the liquid column is reduced before the sealing liquid 9 reaches the top of the inlet and outlet pipe 7. At this time, an increase in the internal pressure of the cooling vessel causes the temperature of the liquid refrigerant 8 to exceed its boiling point. However, since the difference in temperature between outside coolant and the gaseous refrigerant within the condenser 3 becomes large and the condensing capability of the condenser 3 is increased, the rise in the temperature of the liquid refrigerant 8 stops. Also, if the thickness of the inlet and outlet pipe 7 is reduced, it is possible to reduce the quantities of the sealing liquid 9 and the liquid refrigerant 8 entering the pipe 7. By this arrangement, a decrease in the quantity of the liquid refrigerant 8 in the cooling vesel can be avoided.

In the apparatus according to the invention, the heat generating member (semiconductor rectifier) 10 may be arranged outside the evaporator 1 as subsequently to be described, so that the heat of the heat generating member will be transferred through the evaporator 1 and the liquid refrigerant in the evaporator 1 will boil. This arrangement facilitates maintenance of the heat generating member.

Also, the opening at the upper portion of the inlet and outlet pipe 7 need not necessarily face upwardly, and it may be made to face sideways or downwardly so as to prevent the invasion of foreign matter.

It is to be understood that the invention is not limited to the arrangement in which the liquid refrigerant reservoir 6 is connected to the lower portion of the condensing pipe 5. What is essential is that the forward end of the condensing pipe 5 is disposed in the vicinity of the inner surface of the bottom of the liquid refrigerant reservoir 6. For example, the condensing pipe 5 may extend through the upper portion of the liquid refrigerant reservoir 6 to the inner surface of the bottom of the liquid refrigerant reservoir 6. The same is true of the arrangement in which the return pipe 4 is connected to the evaporator 1 within the cooling vessel.

Figure 9:
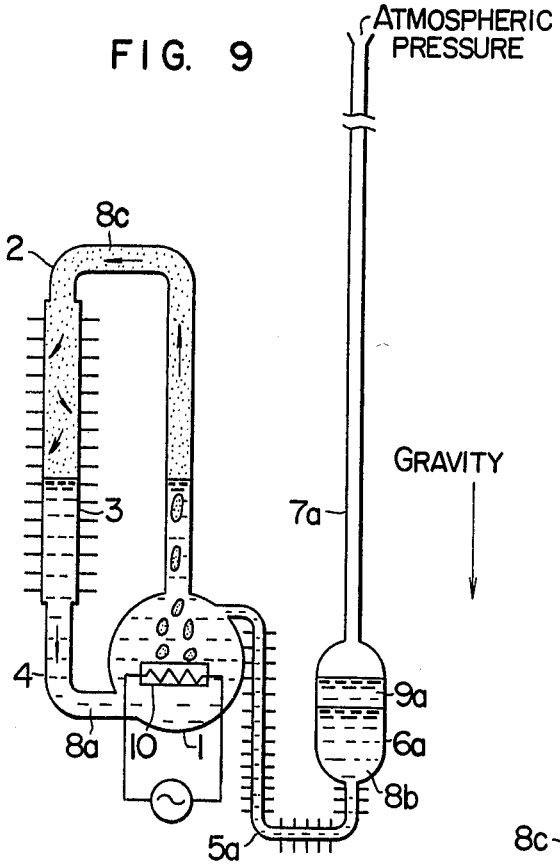

In the embodiments shown in FIG. 1, FIG. 2, FIG. 3, FIG. 4 and FIG. 5, the liquid refrigerant reservoir 6 is disposed above the cooling vessel and communicates with the upper portion of the cooling vessel through the condensing pipe 5. However, the liquid refrigerant reservoir 6 may be disposed in any other position and the condensing pipe 5 may be connected to the cooling vessel in any other position. The object of the invention can be substantially accomplished by arranging the liquid refrigerant reservoir **6*a* in the vicinity of the lower portion of the cooling vessel and connecting the condensing pipe 5*a* directly to the evaporator 1 as shown in FIG. 9. It should be noted however that, if the levels of the position in which the liquid refrigerant is disposed and the position in which the condensing pipe 5** is connected to the cooling vessel are excessively lowered, the function of venting the non-condensable gas in the cooling vessel will not be performed satisfactorily.

In the embodiments shown and described above, the condenser 3 and condensing pipe 5 are shown as directly transferring heat to the atmosphere. It is to be understood that the invention is not limited to this type of outside coolant and that water may be forcibly made to pass outside these members. Also, as shown in FIG. 10, the gaseous refrigerant **8*c* in the condenser 3 may be forcibly cooled by means of a cooling fan 14 as shown in FIG. 10**.

Figure 10:
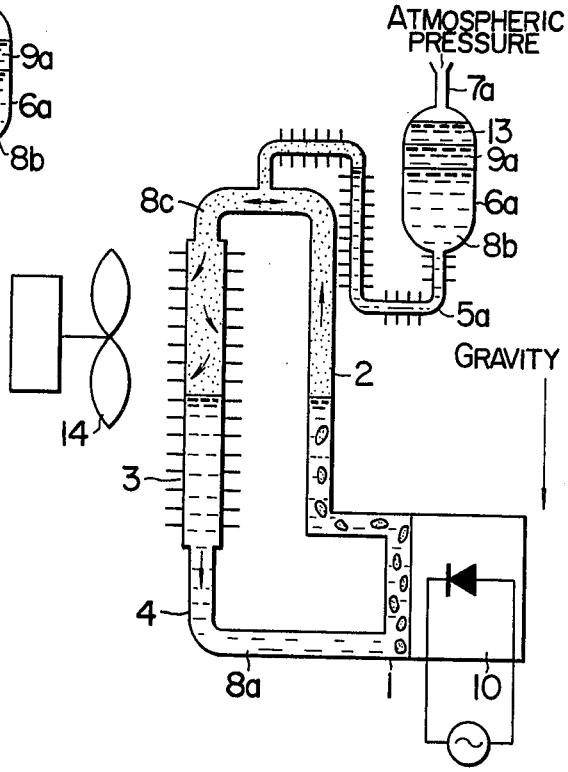

As shown in FIG. 10, a protective layer 13 of a material which is lower in specific gravity than the sealing liquid **9*a* and is immiscible therewith may be provided above the layer of the sealing liquid 9. Such protective layer may be provided to the embodiments shown in FIG. 1 to FIG. 9. The provision of the protective liquid layer 13 has the effect of preventing adverse effects of the atmosphere on the cooling vessel. For example, entry of foreign matter can be avoided. The protective liquid 13 may be selected from the group consisting of mineral oil, alkylbenzene, alkyltoluene, alkylnaphthalene, dimethyl silicone oil, phenylmethyl silicone oil, polybutene, α-olefine polymer, synthetic ester oils, such as the ester of dibasic acid, the ester of neopenthyl polyol and the ester of silicic acid, derivatives of polyphenylether, diarylalkane, and vegetable oils, such as soybean oil and castor oil. Any one of the aforementioned materials may be used singly or two or more of them may be used in the form of a mixture. The protective liquid layer 13 may have a thickness which is sufficiently great to provide a film on the sealing liquid layer 9**.

In the invention, any of the halogenated hydrocarbons used as a liquid refrigerant may be partly replaced by at least one liquid selected from the group consisting of ester oils, such as mineral insulating oil, alkylbenzene, alkylnaphthalene, dimethyl silicone oil, polybuthene, α-olefine polymer, alkyltoluene, derivatives of polyphenylether, diarylalkane, ester oils including the ester of phosphoric acid, the ester of dibasic acid, the ester of neophentyl, the ester of silicic acid and florined ester, and vegetable oils including soybean oil and castor oil. Preferably the volume of the liquid replacing the liquid refrigerant is less than 80 volume % of the whole body of the liquid refrigerant. By using any one of the above-mentioned liquids, it is possible to freely adjust the boiling point of the refrigerant.

The present invention provides an open-type boiling cooling apparatus which offers the unique advantages of being able to maintain the internal pressure of the apparatus as a whole at the atmospheric pressure and to achieve a sufficiently high cooling capability to cool a heat generating member without rendering the construction of the apparatus complex and increasing its size.

We claim:

1. An open-type boiling cooling apparatus comprising: a boiling refrigerant, a cooling vessel including an evaporator section containing said boiling refrigerant and adapted to transfer the heat of a heat generating member to the refrigerant, and a condenser section completely filled with the refrigerant in a liquid state when one of no cooling or slight cooling of the heat generating member is effected, said condenser section during a cooling of the heat generating member accommodating the refrigerant in a gaseous state by displacing an amount of liquid refrigerant therefrom and liquefying the gaseous refrigerant contained therein; said condenser section becoming larger and accommodating a greater volume of gaseous refrigerant in proportion to a quantity of heat generated by the heat generating member, a liquid refrigerant reservoir means open at an upper end thereof and being adapted to store a volume of the liquid refrigerant which does not directly take part in a cooling operation of the heat generating member when a cooling operation is performed; and a communication means for communicating said condenser section with said liquid refrigerant reservoir means such that the amount of liquid refrigerant displaced by the gaseous refrigerant in the condenser section is accommodated in the liquid reservoir means during a cooling operation with the liquid refrigerant being returned to the condenser section when the cooling operation is terminated.

2. An open-type boiling cooling apparatus as claimed in claim 1, wherein said liquid refrigerant reservoir means contains a predetermined quantity of a liquid means of a lower specific gravity than the boling refrigerant for at least preventing effusion of the boiling refrigerant.

3. An open-type boiling cooling apparatus as claimed in claim 2, wherein said liquid means is immiscible with the boiling refrigerant.

4. An open-type boiling cooling apparatus as claimed in claim 3, wherein said liquid means is a polyhydric alcohol.

5. An open-type boiling cooling apparatus as claimed in claim 2, wherein said liquid means comprises a first liquid for preventing the effusion of the boiling refrigerant, and a second liquid of a lower specific gravity than said first liquid for providing protection to said first liquid.

6. An open-type boiling cooling apparatus as claimed in claim 5, wherein said second liquid is at least one of the materials selected from the group consisting of mineral oil, alkylbenzene, alkylnaphthalene, dimethyl silicone oil, phenylmethyl silicone oil, polybutene, $\alpha$-olefine polymer, alkyltoluene, synthetic ester oils, derivatives of polyphenylether, diarylalkane and vegetable oils.

7. An open-type boiling cooling apparatus as claimed in claim 1, wherein said boiling refrigerant is a liquid refrigerant which is one of halogenated hydrocarbons.

8. An open-type boiling cooling apparatus as claimed in claim 1, wherein said communication means includes a downward flow portion as seen from the cooling vessel side.

9. An open-type boiling cooling apparatus as claimed in claim 1, wherein said communication means connects said liquid refrigerant reservoir means to a lower portion of said cooling vessel.

10. An open-type boiling cooling apparatus as claimed in claim 1, wherein said communication means comprises a first communication member connected to a lower portion of said cooling vessel and a second communication member connected to an upper portion of said cooling vessel, and said liquid refrigerant reservoir means comprises a first liquid refrigerant reservoir member connected to said first communicating member and a second liquid refrigerant reservoir member connected to said second communication member.

11. An open-type boiling cooling apparatus as claimed in claim 10, wherein at least either one of said first communication member and said second communication member includes a downward flow portion as seen from the side of the cooling vessel.

12. An open-type boiling cooling apparatus as claimed in claim 1, wherein said liquid refrigerant reservoir means includes an inlet and outlet pipe of a predetermined length connected to the open upper end.

13. An open-type boiling cooling apparatus as claimed in claim 1, wherein said communication means includes a passage having a throttle portion which is narrower than the rest of the passage.

14. An open-type boiling cooling apparatus as claimed in claim 1, wherein the heat generating member is disposed in the evaporator section of the cooling vessel.

15. An open-type boiling cooling apparatus as claimed in claim 1, wherein said communicating means includes a condensing pipe having one end thereof disposed in an area of an inner surface of a bottom wall of the liquid refrigerant reservoir means.

16. An open-type boiling cooling apparatus as claimed in claim 15, wherein said communicating means includes a first end terminating at the cooling vessel and a second end terminating in a lower end of the liquid reservoir means, and wherein said condensing pipe is arranged such that said second end is disposed at a position below said first end.

17. An open-type boiling cooling apparatus as claimed in claim 16 wherein the heat generating member is disposed in the evaporator section of the cooling vessel.

18. An open-type boiling cooling apparatus as claimed in claim 1, wherein a pipe means is provided for communicating said evaporator section with said condenser section, a return line means is provided for communicating said condenser section with the evaporator section, and wherein said communication means for communicating said condenser section with said liquid refrigerant reservoir means includes a condensing pipe extending between a portion of said pipe means and said liquid refrigerant reservoir means.

19. An open-type boiling cooling apparatus as claimed in claim 18, wherein said condensing pipe has an end thereof terminating in an area of an inner surface of a bottom wall of the liquid refrigerant reservoir means.

20. An open-type boiling cooling apparatus as claimed in claim 19, wherein means are arranged at the condenser section for forcibly cooling the gaseous refrigerant.

21. An open-type boiling cooling apparatus as claimed in claim 20, wherein said liquid refrigerant reservoir means contains a first liquid for preventing the effusion of the boiling refrigerant and a second liquid for providing protection to the first liquid.

22. An open-type boiling cooling apparatus as claimed in claim 21, wherein said second liquid is at least one of the materials selected from the group consisting of mineral oil, alkylbenzene, alkylnaphthalene, dimethyl silicone oil, phenylmethyl silicone oil, polybutene, $\alpha$-olefin polymer, alkyltoluene, synthetic ester oils, derivatives of polyphenylether, diarylalkane and vegetable oils.

23. An open-type boiling cooling apparatus as claimed in claim 22, wherein said first liquid is an aqueous solution of at least one of the materials selected from the group consisting of polyhydric alcohols, polysaccharides, polyvinyl alcohols, and glucose.

24. An open-type boiling cooling apparatus as claimed in claim 1, wherein a pipe means is provided for communicating said evaporator section with said condenser section, a return line means is provided for communicating said condenser section with the evaporator section, and wherein said communication means for communicating said condenser section with said liquid refrigerant reservoir means includes a condensing pipe extending between said return line means and a lower portion of said liquid refrigerant reservoir means.

25. An open-type boiling cooling apparatus as claimed in claim 24, wherein said liquid refrigerant reservoir means contains an aqueous solution of at least one of the materials selected from the group consisting of polyhydric alcohols, polysaccharides, polyvinyl alcohols, and glucose.

26. An open-type boiling cooling apparatus as claimed in claim 24, wherein an additional liquid refrigerant reservoir means is provided, and wherein means are provided for communicating said additional liquid refrigerant reservoir means with the cooling vessel.

27. An open-type boiling cooling apparatus as claimed in claim 26, wherein said means for communicating said additional liquid refrigerant reservoir means with the cooling vessel includes a further condensing pipe extending between a portion of said pipe means and a lower portion of said additional liquid refrigerant reservoir means.

28. An open-type boiling cooling apparatus as claimed in claim 27, wherein said liquid refrigerant reservoir means and said additional liquid refrigerant reservoir means each contain an aqueous solution of at least one of the materials selected from the group consisting of polyhydric alcohols, polysaccharides, polyvinyl alcohols, and glucose.

29. An open-type boiling cooling apparatus as claimed in claim 27, wherein said further condensing pipe includes a throttle portion therein.

30. An open-type boiling cooling apparatus as claimed in claim 1, wherein a pipe means is provided for communicating said evaporator section with said condenser section, a return line means is provided for communicating said condenser section with said evaporator section, and wherein said communication means for communicating said condenser section with the evaporator section includes a condensing pipe extending between said evaporator section and a lower portion of the liquid refrigerant reservoir means.

31. An open-type boiling cooling apparatus as claimed in claim 30, wherein said liquid refrigerant reservoir means contains an aqueous solution of at least one of the materials selected from the group consisting of polyhydric alcohols, polysaccharides, polyvinyl alcohols, and glucose.

32. An open-type boiling cooling apparatus comprising: a boiling refrigerant, a cooling vessel including an evaporator section containing said boiling refrigerant and adapted to transfer the heat of a heat generating member to the refrigerant, and a condenser section for liquefying the refrigerant which has been changed to a gaseous state; a liquid refrigerant reservoir means open at its upper end and adapted to store a body of the refrigerant which does not directly take part in a cooling operation when such cooling operation is performed; a communication means for communicating said cooling vessel with said liquid refrigerant reservoir means, said liquid refrigerant reservoir means containing a predetermined quantity of a liquid means of a lower specific gravity than the boiling refrigerant, said liquid means being immiscible with the boiling refrigerant and being an aqueous solution of at least one of the materials selected from the group consisting of polyhydric alcohols, polysaccharides, polyvinyl alcohols, and glucose.

* * * * *